US009707978B2

(12) United States Patent
Kessinger et al.

(10) Patent No.: US 9,707,978 B2
(45) Date of Patent: Jul. 18, 2017

(54) RAILWAY FREIGHT CAR TRUCK WITH TRANSOM

(71) Applicant: AMSTED RAIL COMPANY, INC., Chicago, IL (US)

(72) Inventors: Doug Kessinger, Marine, IL (US); Shawn Peetz, Troy, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 49 days.

(21) Appl. No.: 14/807,371

(22) Filed: Jul. 23, 2015

(65) Prior Publication Data

US 2017/0021843 A1 Jan. 26, 2017

(51) Int. Cl.

| | |
|---|---|
| ***B61F 5/00*** | (2006.01) |
| ***B61F 5/04*** | (2006.01) |
| ***B61F 5/06*** | (2006.01) |
| ***B61F 5/28*** | (2006.01) |

(52) U.S. Cl.

CPC ..... *B61F 5/04* (2013.01); *B61F 5/06* (2013.01); *B61F 5/28* (2013.01)

(58) Field of Classification Search

CPC ..... B61F 5/04; B61F 5/26; B61F 5/32; B61F 5/122; B61F 5/12

USPC ..... 105/223, 198.4, 198.2

See application file for complete search history.

(56) References Cited

U.S. PATENT DOCUMENTS

| | | | | |
|---|---|---|---|---|
| 1,823,884 | A * | 9/1931 | Brittain, Jr. | B61F 15/00 105/209 |
| 4,242,966 | A * | 1/1981 | Holt | B61F 5/04 105/182.1 |
| 5,463,964 | A * | 11/1995 | Long | B61F 5/06 105/187 |
| 6,672,224 | B2 * | 1/2004 | Weber | B61F 5/04 105/187 |
| 2012/0318166 | A1 * | 12/2012 | Wike | B61F 5/127 105/198.2 |
| 2014/0261064 | A1 * | 9/2014 | Wike | B61F 5/52 105/198.4 |

* cited by examiner

*Primary Examiner* — Jason C Smith
(74) *Attorney, Agent, or Firm* — Edward J. Brosius

(57) ABSTRACT

A stabilized railway car truck consists of two side frames and a bolster. The bolster has laterally opposite ends, each end extending into and supported within a side frame opening on a spring group. The stabilized railway car truck also includes a transom extending into, and supported within, a side frame opening. The spring group is supported at each transom end. Each side frame includes an integrally cast transom bearing over which a transom support bearing is fitted. The pivotal decoupling of the side frame and transom eliminates track displacement irregularities from reacting at the bolster and into the vehicle.

4 Claims, 2 Drawing Sheets

RAILWAY FREIGHT CAR TRUCK WITH TRANSOM

BACKGROUND OF THE INVENTION

The traditional three piece railway freight truck consists of one bolster and two side frames that are configured to utilize friction shoes between the bolster and side frames as a means to provide damping of the suspension. The friction shoes additionally provide a limited means to keep the relationship of the side frames aligned squarely to the bolster and wheelsets. Lateral track displacement irregularities are transmitted to the wheelsets and into the side frames creating uneven lateral displacement of the side frames. The uneven displacement of the side frames exceeds the friction shoes' squaring capability, allowing the side frames to pivot or hinge about the friction shoes and bolster. The pivoting or hinging of the side frames yaws the wheelsets, creating misalignment to the railway track, which limits the stability of the traditional three piece freight truck.

The present invention relates to a stabilized railway freight car truck with a rigid transom, pivotally affixed between the side frames. The side frames are also pivotally affixed to the wheelsets. The pivotal relationship of the wheelsets to the side frames and the side frames to the transom allows lateral movement, which prevents the lateral track displacement irregularities from being transmitted to the bolster and into the vehicle. The pivotal but rigid connection between the side frames and transom eliminates yawing of the wheelsets thusly making the railway freight truck stable.

The stabilized railway freight car truck bolster is supported on springs. The springs are supported on the transom which is pivotally supported on the side frames. The friction shoes, located between the bolster and side frames, further decouple lateral track displacement irregularity inputs transmitted to the wheelsets through the side frames by low friction inserts between the friction shoes and bolster.

The stabilized railway freight car truck side frames are longitudinally rigid due to the limited longitudinal space between the transom and the side frames. The longitudinally rigid side frames are connected to the wheelsets by rotating lugs, adapters and elastomeric steering pads. The elastomeric stiffness of the steering pads provides movement to align the wheelsets to the railway track.

It is an object of the present invention to provide a railway freight car truck having improved stability and resistance to misalignment with the track.

SUMMARY OF THE INVENTION

A stabilized railway freight car truck of the three piece design is comprised of two laterally spaced side frames and a laterally extending bolster. A transom extends into an opening in each side frame. The ends of the transom are pivotally supported on transom bearings, which are supported on the lower portion of the center openings of the side frames. The spring suspension is supported on the transom, which in turn supports the bolster.

For stable performance of the railway freight car truck, it is desirable to utilize friction damping in the form of friction shoes between the bolster and the side frame. There is a bolster low friction insert between friction shoes and bolster, as well as a space on either side of the friction shoes to accommodate lateral movement of the friction shoes without transmitting the lateral movement to the bolster.

It is also desirable to have translation and warp constraint between the two side frames. The rotating connections of the transom to the side frames and the side frames to the wheelsets mitigate track input from destabilizing truck performance. The translation or warping of the two side frames is eliminated by utilizing transom bearings integrally cast in the side frames with transom support bearings between the transom bearings and the transom.

DETAILED DESCRIPTION OF THE INVENTION

Figure 1:
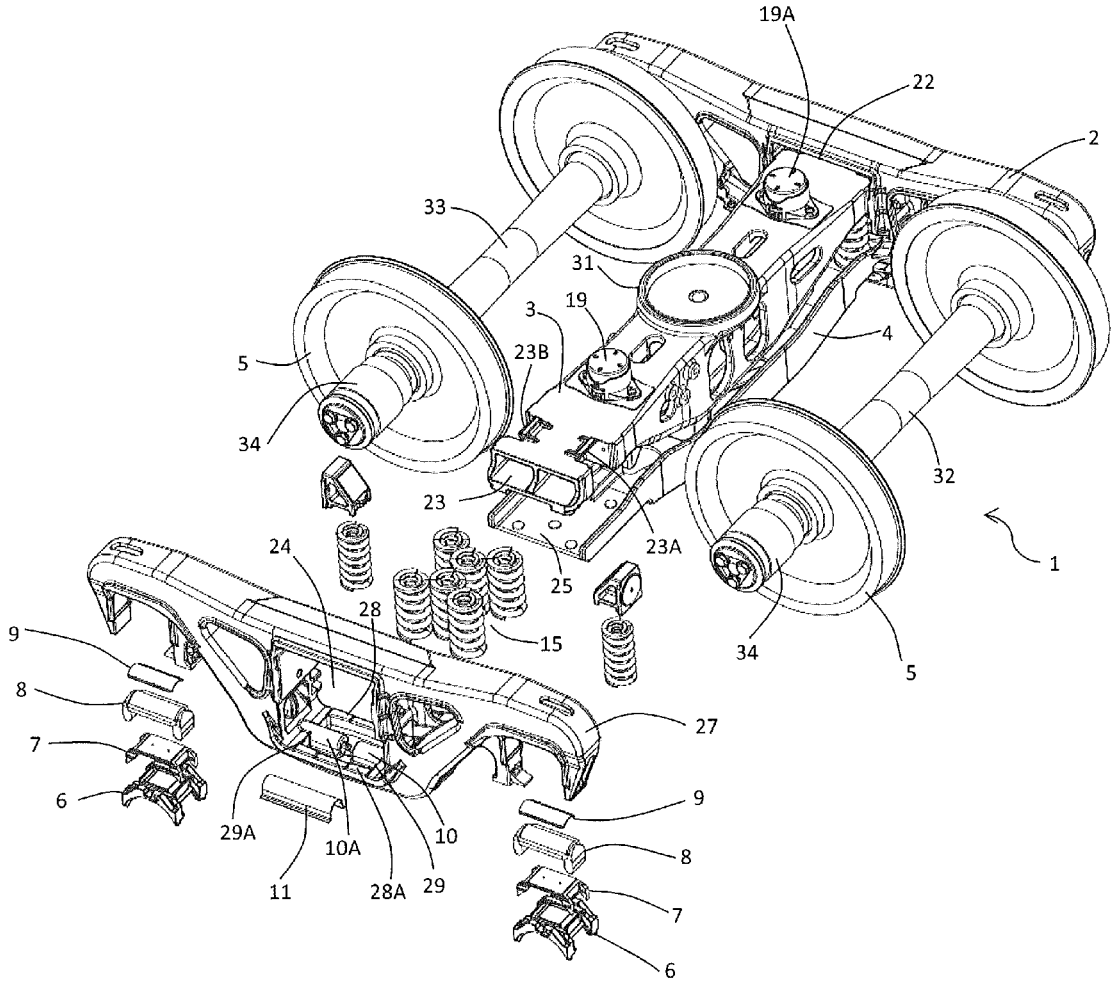
FIG. 1 is a perspective view of the truck assembly of a first embodiment of a stabilized railway car truck with components shown in a separated fashion in accordance with the present invention.

Referring now to FIG. 1, a stabilized railway truck 1 is seen to be comprised of two laterally spaced side frames 2 and 27, between which bolster 3 extends. Bolster 3 is seen to include bolster ends 22 and 23, each of which extends through a side frame opening 24. Transom 4 also extends between side frames 2 and 27 with transom end 25 extending through side frame opening 24. One end of bolster 3 and one end of transom 4 will be described as the identical opposite end is not completely shown in FIG. 1. Transom 4 extends laterally under bolster 3. Transom end 25 supports a spring group 15. Spring group 15, is seen to support bolster end 23. Transom end 25 is supported on transom bearings 10 and 10A, which transom bearings 10 and 10A are integrally cast as raised, generally half cylindrical, separately spaced portions of sideframe support surfaces 28 and 28A. The radial clearance between transom end 25 and transom bearings 10 and 10A is filled by elongated, generally half cylindrical transom support bearing 11. The transom bearing ends 29 and 29A are supported adjacent side frame lower support surfaces 28 and 28A. Each of side frames 2 and 27 and bolster 3 are usually a cast steel unitary structure. Transom 4 can be cast of ductile iron or steel. It is possible for transom 4 to be cast or fabricated of steel, but a cast ductile iron transom is preferred.

Bolster 3 is seen to include on its upper surface a bolster center plate 31, and a pair of laterally spaced side bearings 19 and 19A. Each bolster end includes a pair of sloped surfaces 23A and 23B. Each bolster end slope surface forms a friction shoe pocket with side frame vertical face wearplate 21.

Axles 32 and 33 extend laterally between side frames 2 and 27. Railway wheels 5 are press fit on the ends of axles 32 and 33. The ends of axles 32 and 33 are received in roller bearings 34. Roller bearing 34 supports bearing adapter 6.

Bearing adapter 6 supports elastomeric steering pad 7. Steering pad 7 supports rotating lug 8. Rotating lug 8 is pivotally supported at the pedestal jaw end of side frames 27 and 2. Elongated support bearing 9 is placed between the pedestal jaw end of side frames 2 and 27 and the rotating lug 8.

Figure 2:
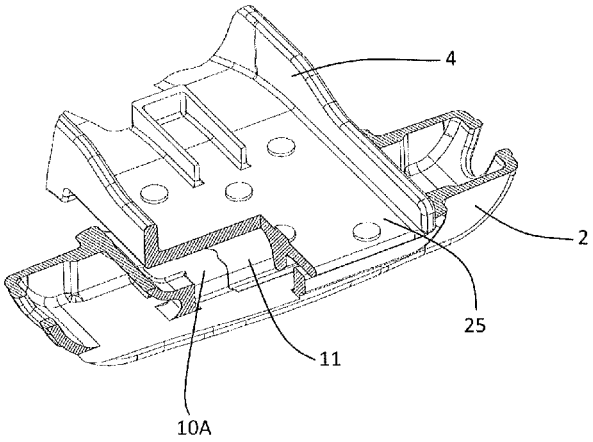
FIG. 2 is a partial perspective view of the transom and the side frame of a first embodiment of a stabilized railway car truck in accordance with the present invention.

Referring now to FIG. 2, a partial detailed perspective cut away view of transom 4 and side frame 2 is shown. Transom 4 extends laterally between side frames 2 and 27. Transom end 25 is supported on transom bearings 10 and 10A which are seen to be integral, generally half cylindrical, longitudinally spaced raised portions of side frame support surfaces 28 and 28A. Transom support bearing 11 is seen to be a generally half cylindrical structure fitted over transom bearings 10 and 10A. Transom support bearing 11 is usually comprised of formed steel or a polymer or a polymer wear liner on a formed steel with a smooth finished surface. Transom support bearing 11 protects transom bearings 10 and 10A from wear.

Figure 3:
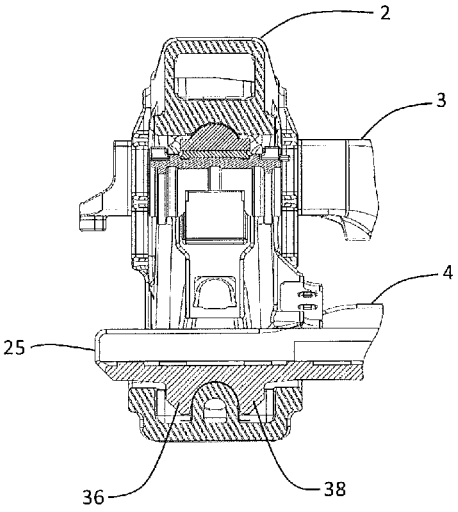
FIG. 3 is a partial cut away side view of the side frame, bolster, and transom of a first embodiment of a stabilized railway car truck in accordance with the present invention.
Figure 4:
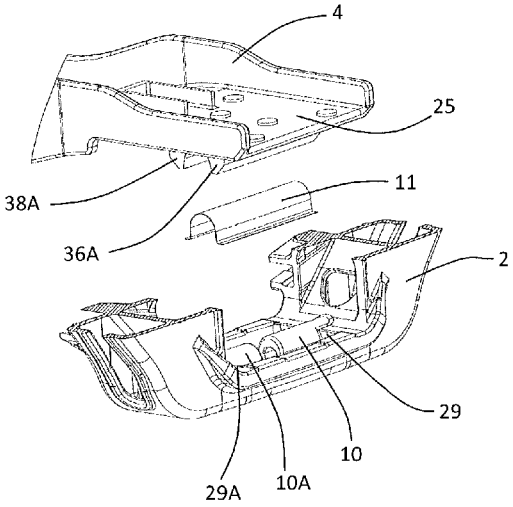
FIG. 4 is a partial sectional view of the transom and side frame of the first embodiment of a stabilized railway car truck with components shown in a separated fashion in accordance with the present invention.

Referring now to FIGS. 3 and 4, a partial cut away view of bolster 3, side frame 2 and transom 4 is presented. Bolster 3 is typically a cast steel unitary device, with internal ribs and supports to provide the strength necessary for a structural component of a stabilized railway freight car truck 1 while providing a generally lower weight structure. Transom end 25 has a lower facing surface which includes transom longitudinal stops 36, 38, 36A and 38A. Transom longitudinal stops 36, 38, 36A and 38A are aligned between transom bearing ends 29 and 29A and fit over transom support bearing 11 which itself is fit over transom bearings 10 and 10A in a complementary manner. Transom longitudinal stops 36, 38, 36A and 38A engage transom bearing ends 29 and 29A to ensure alignment.

Side frames 27 (and similarly 2) pivotally support transom 4 via upraised, integrally cast transom bearings 10 and 10A. Transom support bearing 11 is fitted onto transom bearings 10 and 10A to support transom 4. This makes the connection between the side frame 2 and transom 4 vertically supported, but able to pivotally rotate.

Wheelsets 5 support bearing adapter 6, steering pad 7, rotating lug 8, and support bearing 9 that in turn all support side frames 2 and 27. Side frame 27 in turn includes integrally cast transom bearings 10 and 10A, which together support bearing 11, and then transom 4. The normal vertical load aligns transom bearings 10 and 10A directly below the rotating lug 8 pivot. When a lateral movement is imparted at the bearing adapter 6, the movement reacts through side frame 27 to transom 4. The lateral movement mitigates the railway track lateral displacement irregularities from transom 4.

What is claimed is:

1. A railway freight car truck comprising:
a pair of parallel side frames,
a transom extending laterally between the side frames,
a bolster extending laterally between the side frames,
each side frame including a support surface,
a transom bearing extending as an integral raised portion from each side frame support surface,
each side frame also including
a transom support bearing supported on each transom bearing,
and an end of the transom including a lower surface having a pair of longitudinal stops,
each end of the transom supported on each transom support bearing,
a spring group supported by an end of the transom,
a bolster end supported by the spring group,
a pair of axles extending laterally between the side frames,
each side frame having a pedestal formed at an end of the side frame,
an axle bearing fitted to an end of each axle supporting the pedestal of the side frame, a bearing adapter supported on each axle bearing, an elastomeric steering pad supported on each bearing adapter, a rotating lug supported on each elastomeric steering pad, an elongated support bearing on each rotating lug, and a pedestal jaw end in each side frame relieving the elongated support bearing.

2. The railway freight car truck of claim 1
wherein the transom bearing comprises two longitudinally spaced sections.

3. A railway freight car truck comprising:
a pair of parallel side frames,
a transom extending laterally between the side frames,
a bolster extending laterally between the side frames,
each side frame including a support surface,
a transom bearing extending as an integral cast raised portion of each side frame support surface,
a transom support bearing supported on each transom bearing,
and an end of the transom supported on each transom support bearing,
a spring group supported by an end of the transom,
a bolster end supported by the spring group,
a pair of axles extending laterally between the side frames,
each side frame having a pedestal formed at an end of the side frame,
an axle bearing fitted to an end of each axle supporting the pedestal of the side frame,
a bearing adapter supported on each axle bearing, an elastomeric steering pad supported on each bearing adapter, a rotating lug supported on each elastomeric steering pad, and elongated support bearing on each rotating lug, and each rotating lug received in a side frame pedestal.

4. The railway freight car truck of claim 3
wherein the transom bearing comprises two longitudinally spaced sections.

* * * * *